US005810473A

United States Patent [19]

Manabe et al.

[11] Patent Number: 5,810,473

[45] Date of Patent: Sep. 22, 1998

[54] METHOD FOR TREATING LIQUID IN A TANK AND LIQUID JETTING DEVICE USED IN THE METHOD

[75] Inventors: Nobuyuki Manabe, Fujisawa; Takahiro Goto, Yachiyo, both of Japan

[73] Assignee: Taiho Industries Co., Ltd., Tokyo, Japan

[21] Appl. No.: 762,965

[22] Filed: Dec. 10, 1996

[30] Foreign Application Priority Data

Dec. 11, 1995 [JP] Japan ..... 7-345473
Dec. 15, 1995 [JP] Japan ..... 7-347175

[51] Int. Cl.[6] ..... B01F 15/02; B01F 5/04; B08B 9/093

[52] U.S. Cl. ..... 366/132; 366/137; 366/173.1; 366/182.1; 134/167 R; 134/181; 134/8; 239/227

[58] Field of Search ..... 366/136, 137, 366/165.1, 165.4, 165.5, 182.1, 167.1, 173.1, 173.2, 132, 608; 239/227, 226, 225.1; 134/167 R, 180, 181, 8; 210/205, 194, 220, 525

[56] References Cited

U.S. PATENT DOCUMENTS

| | | | |
|---|---|---|---|
| 1,838,634 | 12/1931 | Peterson et al. . | |
| 2,342,559 | 2/1944 | Sebald et al. | 366/137 |
| 3,166,300 | 1/1965 | Richter | 366/173.2 |
| 3,402,725 | 9/1968 | Booth | 134/167 R |
| 3,696,825 | 10/1972 | Guignon et al. . | |
| 3,895,756 | 7/1975 | Jaeger | 239/227 |
| 4,146,406 | 3/1979 | Sampsell . | |
| 4,332,484 | 6/1982 | Peters | 366/167.1 |
| 4,364,776 | 12/1982 | McBride et al. | 366/137 |
| 4,367,048 | 1/1983 | Morita | 366/137 |
| 4,515,312 | 5/1985 | Manabe et al. | 239/227 |
| 4,716,917 | 1/1988 | Schmidt | 239/227 |
| 4,817,653 | 4/1989 | Krajicek et al. | 239/227 |
| 5,078,799 | 1/1992 | Matter et al. | 134/167 R |
| 5,293,887 | 3/1994 | Thibodeaux . | |
| 5,300,232 | 4/1994 | Barrington et al. | 366/173.2 |
| 5,445,173 | 8/1995 | Aiken . | |
| 5,458,414 | 10/1995 | Crump et al. | 366/137 |
| 5,470,459 | 11/1995 | Barrington et al. | 366/173.1 |
| 5,640,982 | 6/1997 | Landry et al. | 239/227 |

FOREIGN PATENT DOCUMENTS

| | | |
|---|---|---|
| 2 288 850 | 5/1976 | France . |
| 87 00 079 | 6/1988 | Germany . |

*Primary Examiner*—Tony G. Soohoo
*Attorney, Agent, or Firm*—Oblon, Spivak, McClelland, Maier & Neustadt, P.C.

[57] ABSTRACT

A method for treating liquid stored in a tank includes the steps of installing a liquid jetting device having a nozzle in a tank, providing the device with separate power sources for swinging the nozzle in the vertical and horizontal directions, jetting liquid from the nozzle at high pressure, monitoring the jetting of liquid from outside the tank, and controlling the power sources from outside the tank. The liquid jetting device used in the method includes a frame mounted on the tank, a casing provided to be swingable inside the frame, a first shaft extending laterally inside the casing, a jet nozzle for jetting liquid provided to be swingable by the first shaft in a direction perpendicular to the swinging direction of the casing, a first power source for swinging the casing, a second power source for swinging the jet nozzle in the direction perpendicular to the swinging direction of the casing, and means enabling the driving of the first and second power sources to be controlled from outside the tank.

11 Claims, 7 Drawing Sheets

METHOD FOR TREATING LIQUID IN A TANK AND LIQUID JETTING DEVICE USED IN THE METHOD

BACKGROUND OF THE INVENTION

1. Field of the Invention

This invention relates to a method for treating liquid stored in a tank and a liquid jetting device used in the method and, more particularly, to a method for treating any of various types of liquid stored in tanks including petroleum tanks and other such relatively large-scale oil tanks in order to, for example, fluidize petroleum to prevent the precipitation of sludge or remove sludge deposited on the tank floor and to a liquid jetting device enabling the liquid treatment to be completed with very high efficiency.

2. Description of the Prior Art

When the pour point of a liquid stored in a tank is higher than the temperature of the atmosphere inside the tank, the liquid is stored at a temperature at least as high as the pour point. The heating of the liquid stored in the tank to such a temperature is achieved by, for example, installing a heating pipe in a looped or winding pattern on the floor of the tank and passing a heated liquid or steam through the pipe.

When the liquid stored in a tank is heated by this method, the liquid above the heating pipe is warmed by convection and assumes a fluid state. In contrast, the liquid under or remote from the heating pipe is outside the range of the heat convection and assumes a solid state lacking fluidity. Since it remains stagnant without mixing or movement, it deposits on the tank floor as solidified oil consisting mainly of suspended wax, i.e., as sludge. A similar situation also occurs when the tank is not heated.

No efficient method has been available for washing and removing this sludge from the tank, particularly that deposited underneath the heating pipe, and workers have had to remove the sludge with scoop shovels or the like after draining most of the liquid from the tank.

As a method for fluidizing and removing deposited sludge from a floating-roof petroleum tank, Japanese Utility Model Publication Sho 63-44147 teaches a method in which cylindrical washers bendable at flexible joints are mounted in appropriate support column holes in the floating roof, washing liquid is jetted from the washers under high pressure to break down and fluidize the sludge, and the fluidized sludge is pumped up and discharged to the tank exterior.

The conventional sludge removal method that relies on manpower not only is very inefficient and time consuming but also dangerous owing to the highly explosive atmosphere produced by the inflammable gas that fills the interior of the tank. It also involves many difficulties from the points of personnel safety and hygiene owing to, for example, the progressive detrimental effect on worker health caused by inhalation of the inflammable gas, which is a narcotic.

In the method that involves mounting bendable cylindrical washers in support column holes in the floating roof of a floating-roof tank, jetting washing liquid from the washers under high pressure to break down and fluidize the sludge, and pumping up and discharging the fluidized sludge to the tank exterior, the liquid has to be jetted from the washers installed in the roof under extremely high pressure in order to break down the sludge. This makes it necessary to use large-scale equipment. Since the support columns have to be removed for installation of the washers, moreover, the strength of the roof support is markedly lowered, making it necessary to conduct the work on top of an unstable floating roof. This is also dangerous.

To use this method to wash an oil tank measuring 80-plus meters in diameter and 20-plus meters in height and capable of storing around 100 thousand tons of petroleum, for instance, it is necessary to install about 30 washers on the roof, all of which are required to jet liquid under high pressure if rapid and reliable fluidization of the sludge deposits on the tank floor is to be achieved. The washing system therefore becomes very large and, in addition, considerable work is required for installing the complex network of hoses, pipes, change-over valves, branches and the like needed for conveying the high pressure oil. This increases the likelihood of dangerous accidents during the washing operation. Another problem is that the washers mounted on the roof of the floating-roof oil tank are limited to a small diameter and scale owing to the small diameter of the support column holes through which they pass into the interior of the tank. This makes it difficult to raise the pressure of the liquid jetted by the washers to an adequate level and thus limits the efficiency of the washing operation.

Since the jetting of the high-pressure liquid by the washers cannot be easily regulated from outside the tank, moreover, the progress of the sludge removal treatment cannot be accurately ascertained. This makes it impossible to adopt a suitable operating program.

Owing to these shortcomings of the prior art, a need has been felt for a liquid treating method and a liquid jetting device which are capable of jetting liquid at high pressure by use of very simple equipment, controlling the amount and direction of the jetted liquid with ease and exactitude and enabling fluidization and other treatments of deposited sludge with high reliability and efficiency.

SUMMARY OF THE INVENTION

For achieving these objects, the invention provides a method for treating liquid stored in a tank comprising the steps of installing a liquid jetting device having a nozzle swingable in a vertical direction and a horizontal direction in a tank, providing the device with separate power sources for swinging the nozzle in the vertical and horizontal directions, jetting liquid from the nozzle at high pressure, monitoring the jetting of liquid from outside the tank, and simultaneously controlling the driving by the power sources from outside the tank to efficiently treat the liquid in the tank.

The liquid jetting device is installed at the bottom of the tank side wall and, when necessary, also in the roof of the tank. It can be attached to an opening section formed in the tank. The liquid jetted at high pressure from the nozzle of the device to fluidize and remove sludge deposits at the bottom of the tank can be liquid remaining inside the tank which is recirculated, with heating if necessary, or can be liquid obtained by recovering the liquid at the bottom of the tank to a reduced pressure recovery tank and reusing the recovered liquid for jetting at high pressure from the nozzle.

In one mode of operation, the liquid jetted at high pressure from the nozzle stirs liquid remaining in the tank, thereby preventing the sludge from being deposited on the bottom of the tank and the liquid is jetted directly onto the sludge remaining at the bottom of the tank so as to break down, fluidize and remove the sludge. The angular range and the speed of the swinging of the nozzle by the power sources (which can be air motors, for example) can be controlled by varying the supply of a driving fluid (air, for example) to the power sources.

The invention further provides a liquid jetting device comprising a frame, a casing provided to be swingable inside the frame, a first shaft extending laterally inside the casing, a jet nozzle for jetting liquid provided to be swingable by the first shaft in a direction perpendicular to the swinging direction of the casing, a first power source for swinging the casing, a second power source for swinging the jet nozzle in the direction perpendicular to the swinging direction of the casing, and means enabling the driving of the first and second power sources to be controlled from outside the tank in accordance with the state of liquid jetting from a port of the jet nozzle.

The invention also provides a liquid jetting device further comprising means for enabling the angular range and speed of the swinging of the nozzle by the first and second power sources to be controlled from outside the tank by varying a supply of driving fluid to the power sources.

In accordance with the method for treating liquid stored in a tank according to the invention, therefore, sludge deposited inside a tank is removed, not by hand, but by installing one or more liquid jetting devices at the bottom of the tank side wall. As a result, no need arises to install complicated piping and since it becomes unnecessary for workers to conduct the liquid treatment from high places such as the roof of the tank, the risk of dangerous accidents is greatly reduced. In addition, the amount of work involved in setting up and removing the equipment and pipes for the liquid treatment is markedly reduced. Since the nozzle is simultaneously oscillated in the vertical and horizontal directions and the speed and angular range of the swings can be controlled by the separate power sources, the jetting of the liquid from the nozzle port can be controlled in accordance with the condition of the deposited sludge to achieve efficient and rapid fluidization and removal of the sludge.

According to the invention, since the liquid jetting device can be installed at an opening section located at the bottom of the tank side wall, no need arises to install complicated piping, and since it becomes unnecessary for workers to conduct the liquid treatment from high places such as the roof of the tank, the risk of dangerous accidents is greatly reduced. In addition, the amount of work involved in setting up and removing the equipment and pipes for the liquid treatment is markedly reduced. Since the nozzle is simultaneously oscillated in the vertical and horizontal directions and the speed and angular range of the swings can be controlled by the separate power sources, the jetting of the liquid from the nozzle port can be controlled in accordance with the condition of the deposited sludge to achieve efficient and rapid fluidization and removal of the sludge.

Further, in an oil tank having the liquid jetting device of this invention installed at the side wall thereof, the liquid jetted at high pressure from the device can fluidize the liquid stored in the tank, such as petroleum, to prevent the precipitation of sludge.

The above and other objects, characteristic features and advantages of this invention will become apparent to those skilled in the art from the description of the invention given hereinbelow with reference to the accompanying drawings.

DESCRIPTION OF THE PREFERRED EMBODIMENTS

Figure 1:
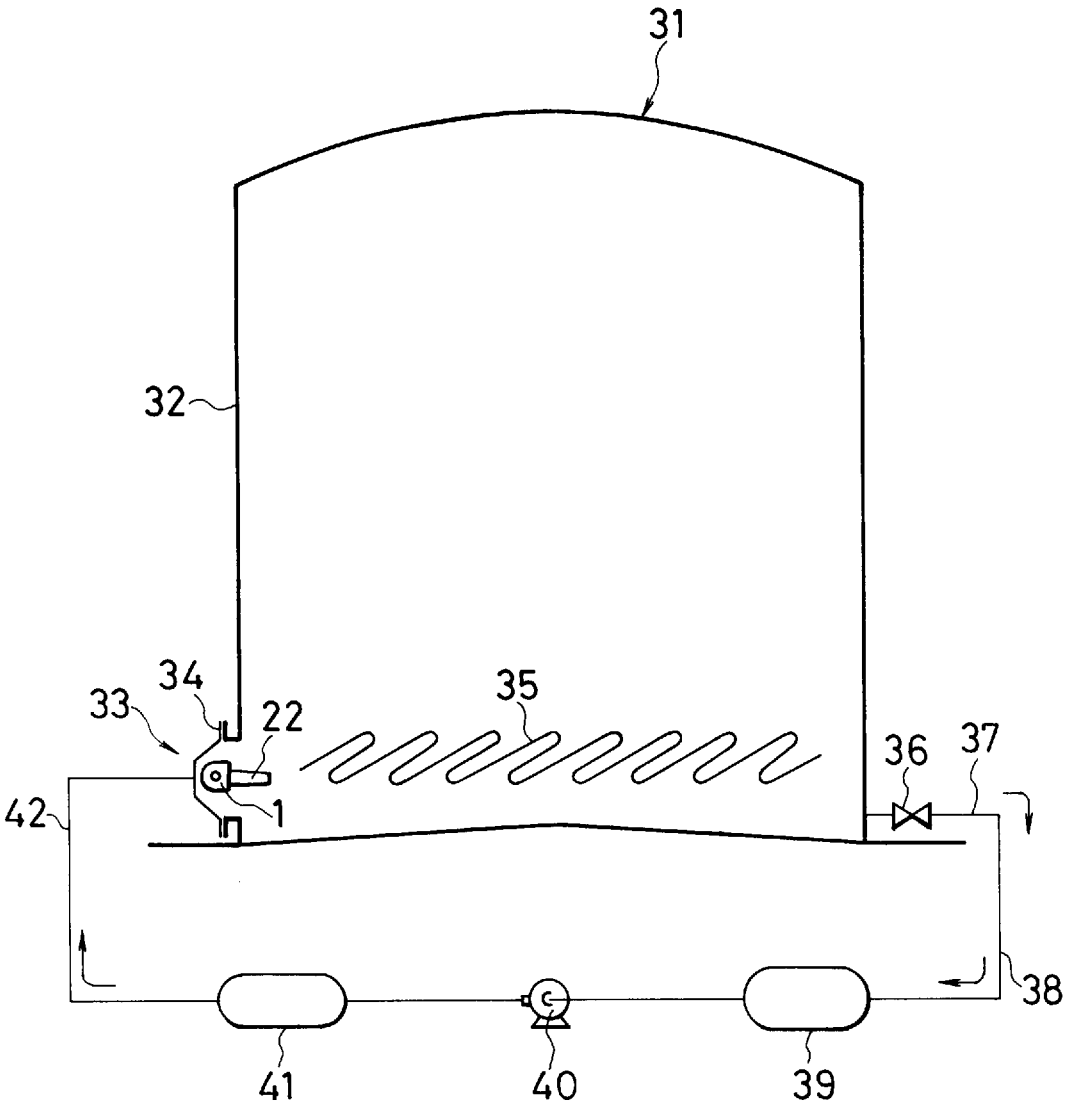
FIG. 1 is a schematic diagram showing an embodiment of the liquid jetting device according to the invention installed in a tank.

The washer 1 in the illustrated embodiments of this invention is installed in a cover 34 attachable to and detachable from an opening section 33 formed in the bottom of a side wall 32 of a tank 31.

The tank 31 shown in FIG. 1 stores any of various kinds of oil, such as petroleum, and incurs sludge deposits on the inside. The bottom of the side wall 32 is formed with appropriately spaced opening sections 33 having detachable covers 34. A heating device 35 formed of a looped or winding heating pipe is provided in the interior of the tank 31 on a level with the bottom of the side wall 32. The heating device 35 heats and fluidizes the liquid present at the bottom of the tank 31 as well as the sludge deposited on the floor of the tank.

Figure 2:
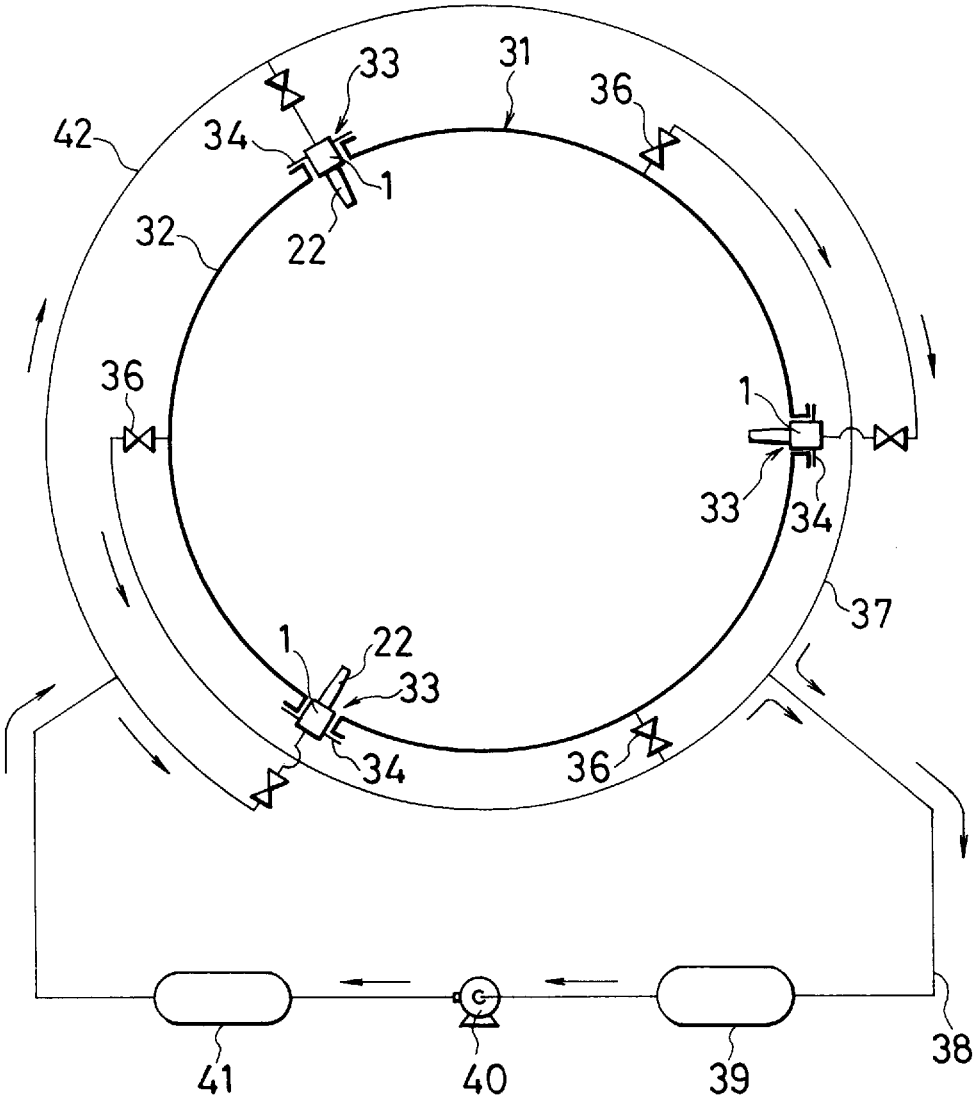
FIG. 2 is a schematic plan view of the tank of FIG. 1.

FIGS. 1 and 2 schematically illustrate one example of the piping arrangement for the tank 31. In this example, multiple fluidized liquid recovery paths 37 are connected to the tank 31 through drain valves 36. The recovery paths 37 converge at a discharge pipe 38 connected to a recovery tank which, in this example, is a suction vessel 39 for maintaining a reduced pressure state. The liquid in the suction vessel 39 is forwarded through a pump 40 to a heat exchanger 41, where it is heated, and then through a supply pipe 42 to the inlet pipes of the washers 1 at the opening sections 33 to be jetted at high pressure from the ports of the washer nozzles.

Figure 3:
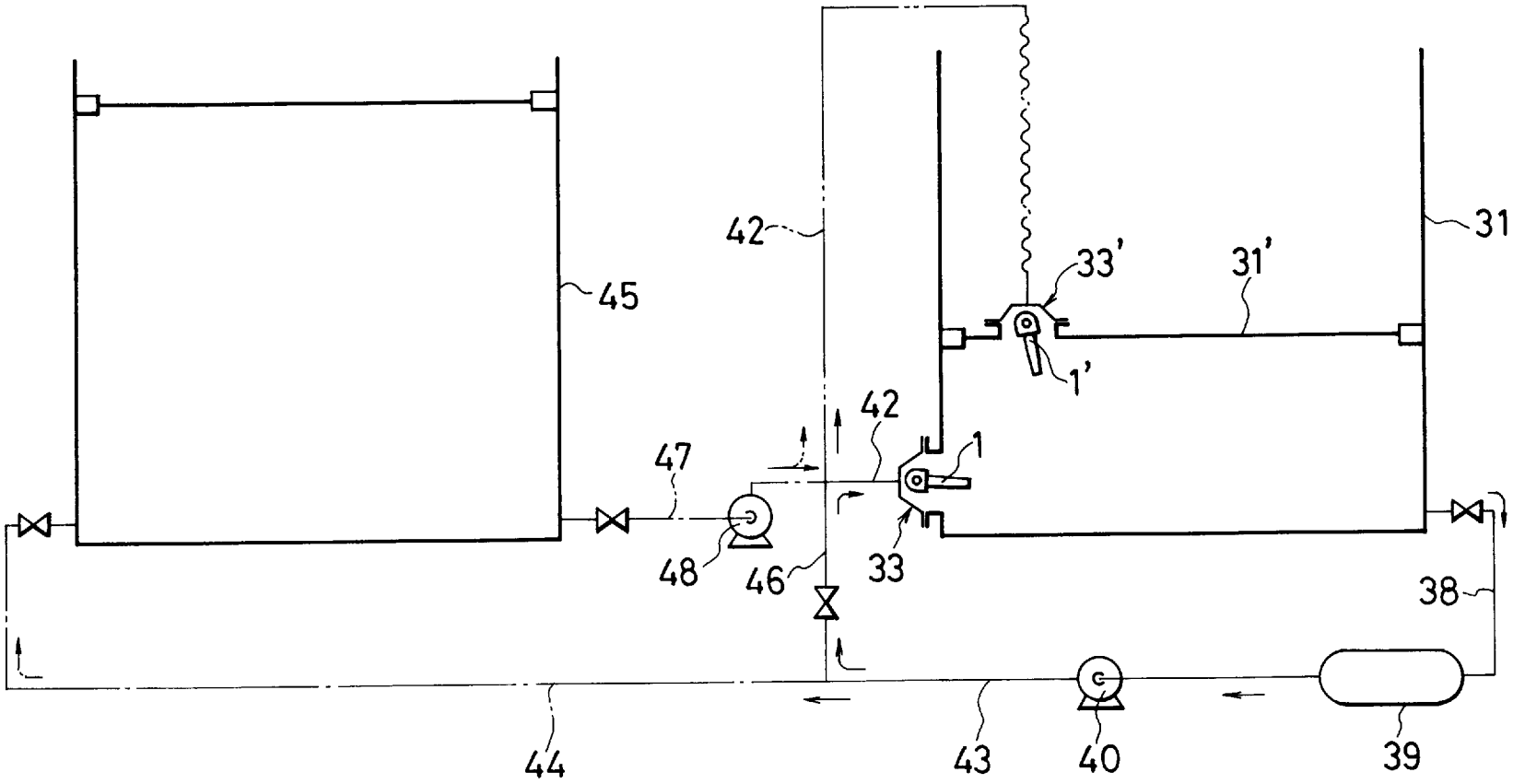
FIG. 3 is a schematic diagram showing another embodiment of the liquid jetting device according to the invention installed in a tank.
Figure 4:
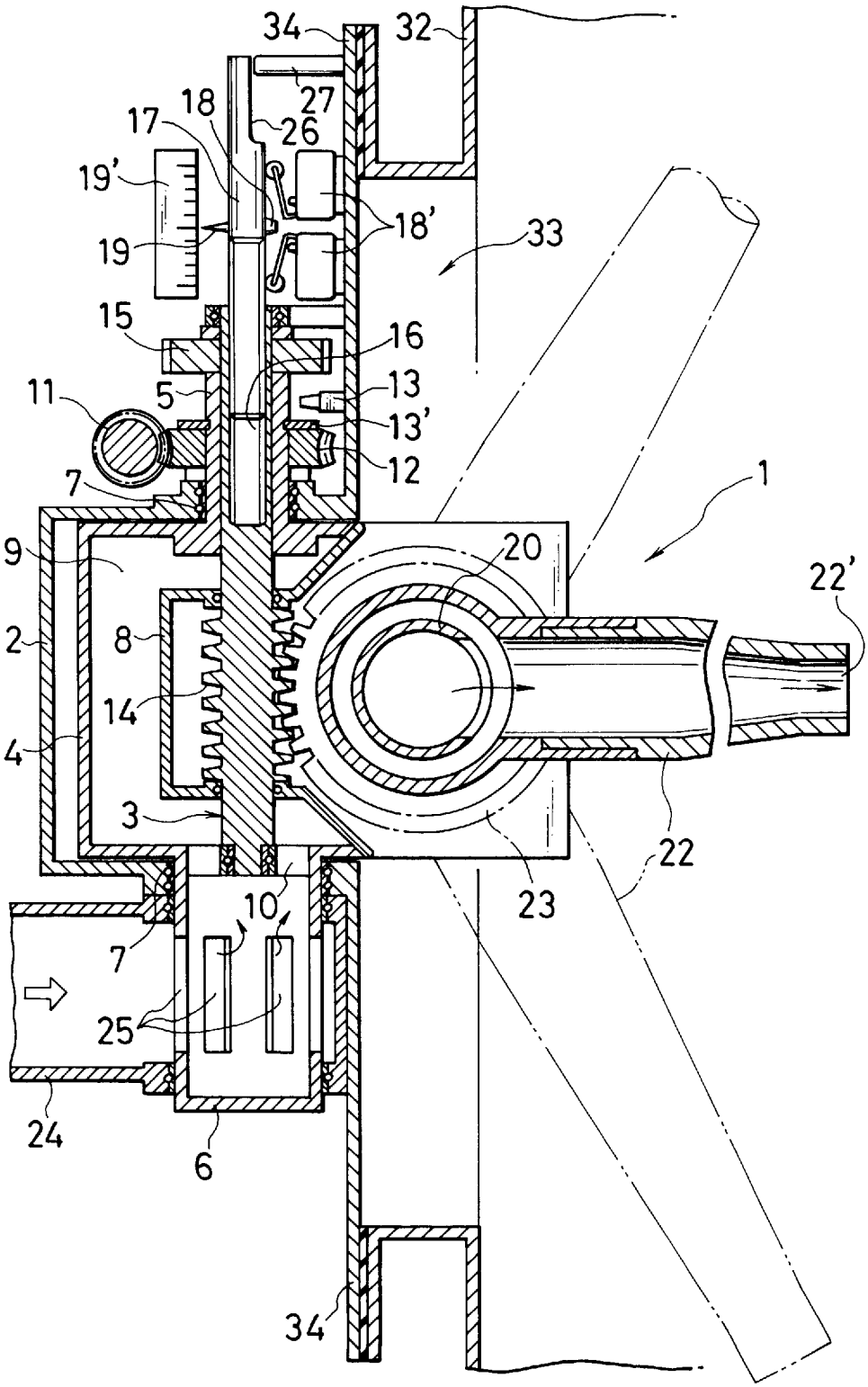
FIG. 4 is a top horizontal sectional view of an embodiment of the liquid jetting device according to the invention.
Figure 5:
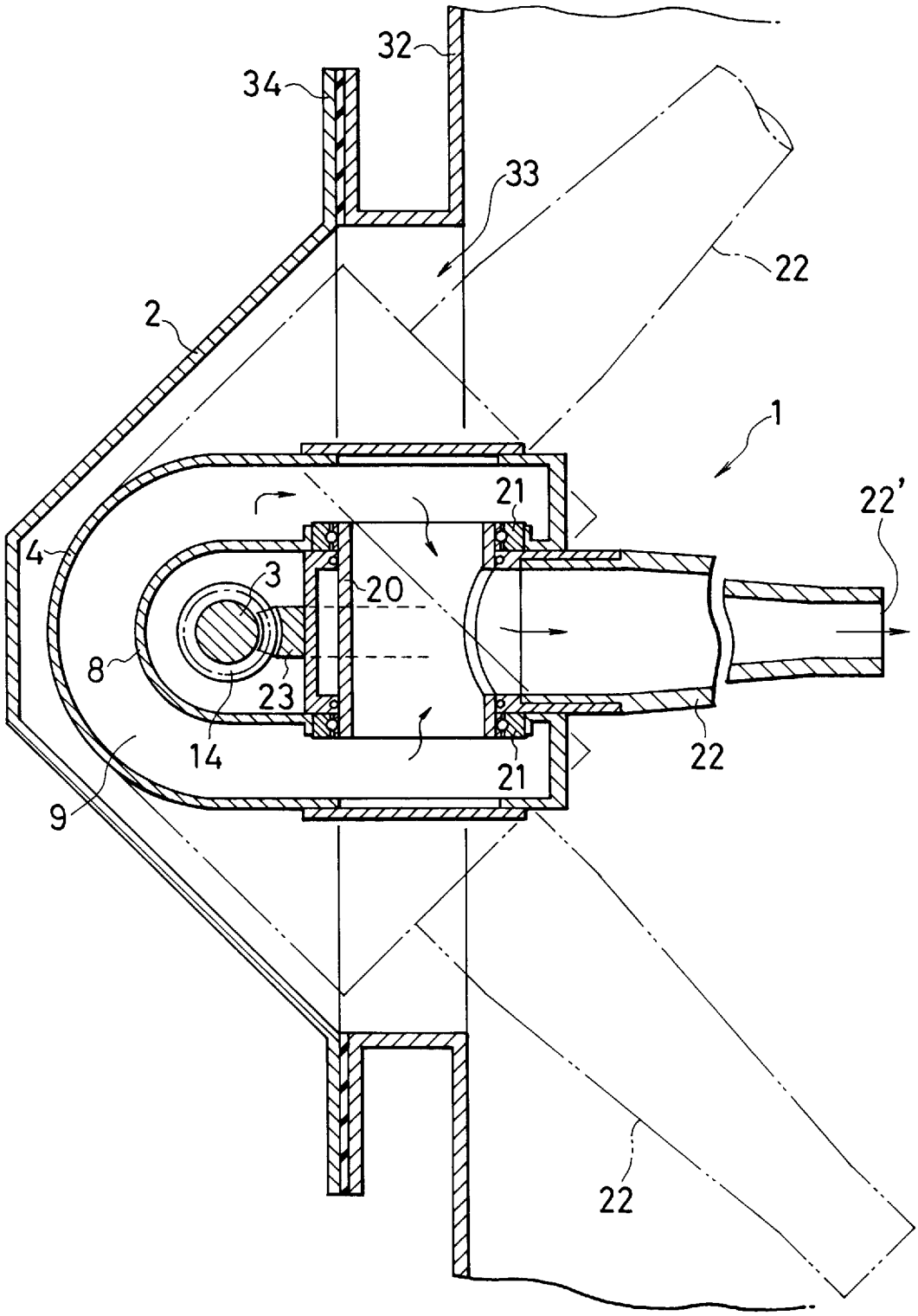
FIG. 5 is side vertical sectional view of the liquid jetting device of FIG. 4.
Figure 6:
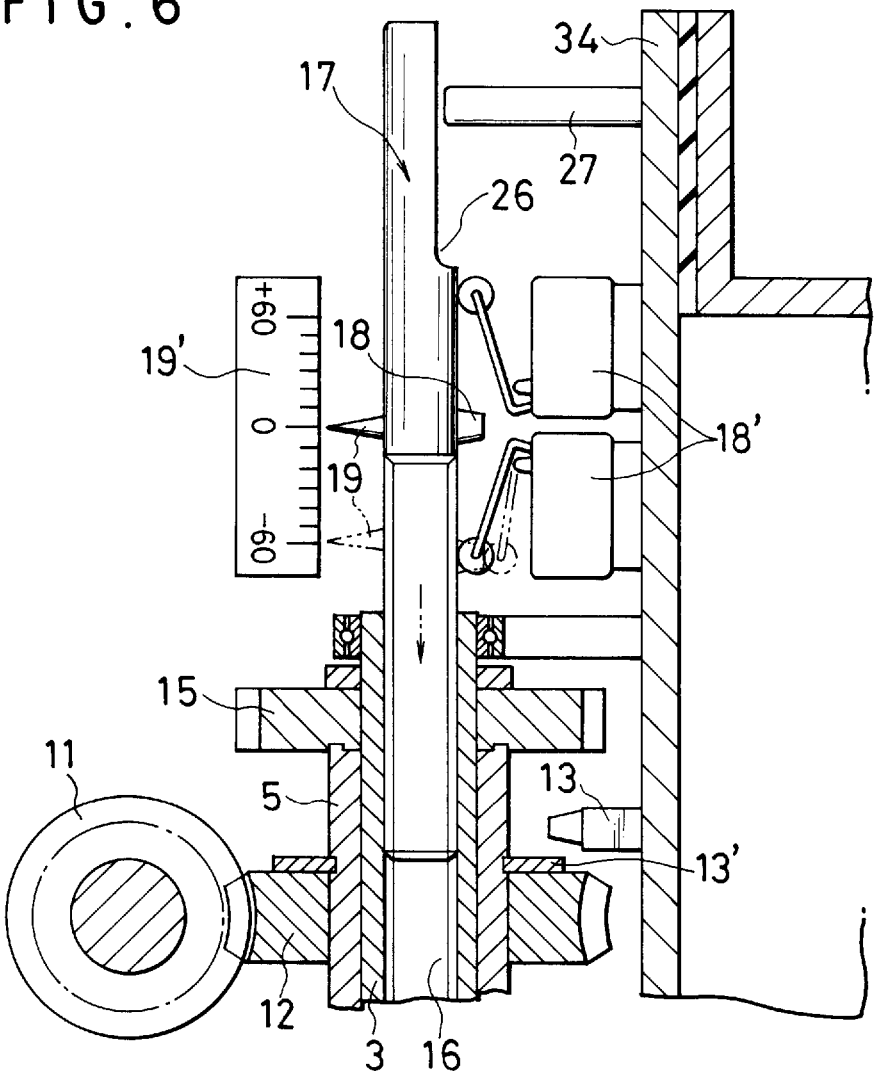
FIG. 6 is an enlarged view of a sensor mechanism of the liquid jetting device of FIG. 4.
Figure 7:
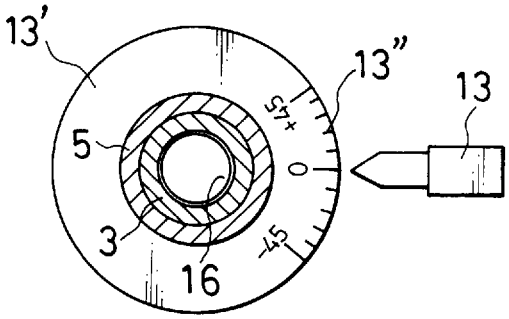
FIG. 7 is a diagram for explaining the positional relationship between a position sensor and a detection piece of the sensor mechanism shown in FIG. 6.
Figure 8:
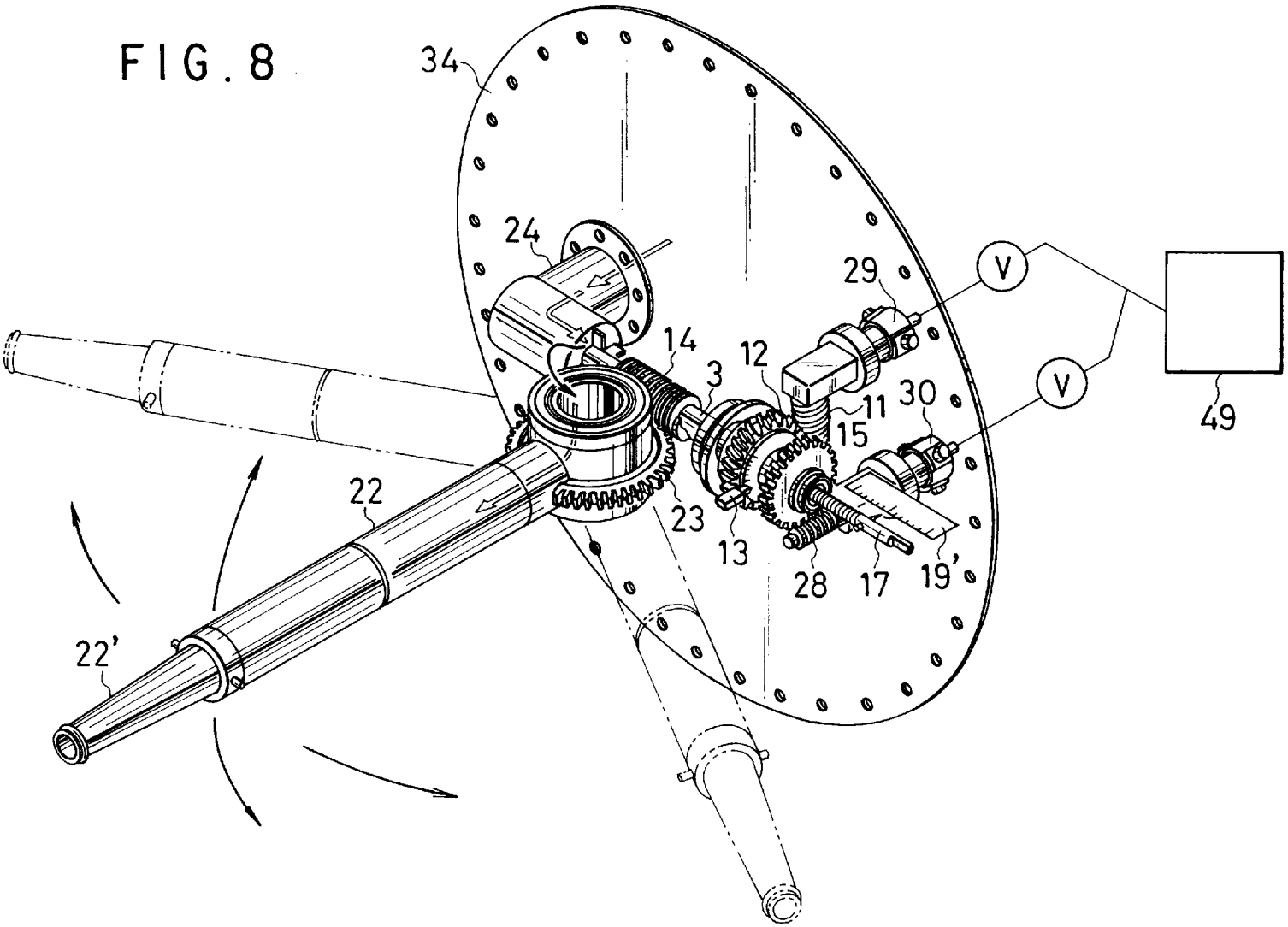
FIG. 8 is perspective view of an essential portion of a liquid jetting device according to the invention.

FIG. 3 shows another embodiment of the liquid jetting device having a different piping arrangement applicable to a tank 31 of the floating roof type. As shown, the discharge pipe 38 is connected with a suction vessel 39 which in turn is connected with a pump 40 for pumping the liquid in the suction vessel 39 forward. A discharge pipe 43 extending from the delivery side of the pump 40 branches into one branch pipe 44 connected to a separate storage tank 45 and another branch pipe 46 connected with a supply pipe 42. The supply pipe 42 is connected to washers 1 provided at opening sections 33 at the bottom of the tank side wall and to washers 1' provided at opening sections 33' of a floating roof 31'. In addition, an outlet pipe 47 extending from the storage tank 45 is connected to the supply pipe 42 via a pump 48.

In this embodiment of the invention, the washing liquid stored in the storage tank 45 and supplied to the washers 1, 1' can be oil obtained by water-oil separation in the suction vessel 39 or oil or liquid from another source. It is also possible to equip the storage tank 45 with a heater for controlling the temperature of the washing liquid supplied to the washers 1, 1'. In addition, the flow of washing fluid can be switched between the branch pipes 44 and 46 for selectively supplying the washers 1, 1' with liquid from the suction vessel 39 or the storage tank 45.

In any of the aforesaid cases, the sludge accumulated on the floor of the tank can be fluidized and discharged by the washing liquid jetted from the washers 1, 1', thereby enabling cleaning of the tank interior.

When the washing of the tank 31 is carried out after most of the oil or the like has been discharged, the sludge is easily fluidized owing to the direct jetting of the washing liquid thereon by the washers 1, 1'. On the other hand, when the jetting of the washing liquid from the washers 1, 1' is conducted with oil or the like present in the tank 31, the sludge is fluidized by the turbulent action of the oil etc. produced by the stirring effect of the jetted washing liquid. As a result, the fluidized sludge can be discharged from the tank as mixed with the tank oil etc.

The washer 1 for implementing the tank washing method of the invention will now be explained with reference to FIGS. 4–8.

A washer frame 2 is mounted on the cover 34 which is in turn attached at the opening section 33 of the tank 31.

A casing 4 is housed inside the washer frame 2 and a first cylindrical member 5 and a second cylindrical member 6 are provided to extend outward from opposite sides of the casing 4. The cylindrical members 5 and 6 are rotatably supported by bearings 7 provided in the opposite side walls of the washer frame 2. As a result, the casing 4 within washer frame 2 can swing vertically about the cylindrical members 5, 6.

The interior of the casing 4 is partitioned by a partition frame 8 so as to form a liquid passage 9 which is continuous vertically, horizontally and to the rear. A first shaft 3 is rotatably supported within the first cylindrical member 5 and traverses the interior of the casing 4 to have its distal end rotatably supported by a crucifix bearing section 10 formed in the open end of the second cylindrical member 6.

Thus the first shaft 3 extends across the central portion of the washer frame 2, passes through the first cylindrical member 5 of the casing 4 and has its distal end supported by the bearing section 10 formed in the second cylindrical member 6, while the first cylindrical member 5 and the second cylindrical member 6 are rotatably supported by the bearings 7 of the washer frame 2. As a result, the casing 4 can swing vertically about the axis of the first shaft 3 as supported by the bearings 7 held by the cylindrical members 5, 6.

A first worm gear 12 engaged with a first worm 11 is fixed on an extended portion of the first cylindrical member 5 projecting outward from one side wall of the washer frame 2. The first worm 11 is connected to a first power source 29 (an air motor, hydraulic motor or the like) whose speed can be freely regulated and direction of rotation reversed.

When the first worm 11 is driven by the first power source 29, its rotation is transmitted to the first cylindrical member 5 through the first worm gear 12 at a greatly reduced speed so that the first cylindrical member 5 rotates slowly, whereby the casing 4 in the washer frame 2 swings vertically about the bearings 7. When the casing 4 has swung to a prescribed angle, a position sensor 13 provided on the cover 34, for example, detects a detection piece 13' provided on the surface of the first worm gear 12, whereupon the first power source 29 reverses its direction to cause the casing 4 to swing in the opposite direction. As a result, the casing 4 is swung up and down about the first shaft 3 by the first power source 29 with a fixed range determined by the position sensor 13 and the detection piece 13'. The position sensor 13, which can operate electrically, optically or mechanically, is configured to enable adjustment of the operating range. The surface of the detection piece 13' is printed or inscribed with an angle scale 13", whereby the position sensor 13 and the detection piece 13' can serve as an indicator of the vertical swing angle of the casing 4. The vertical position to which the casing 4 is swung can therefore be readily ascertained from outside the tank.

The inner middle section of the first shaft 3 enclosed by the partition frame 8 is formed with a second worm 14, and a drive gear 15 for rotating the first shaft 3 is provided on the end of the first shaft 3 projecting outward of the first cylindrical member 5. The drive gear 15 is engaged with a third worm 28 which is connected to a second power source 30 (an air motor, hydraulic motor or the like) which, like the first power source, can be freely regulated as regards speed and direction of rotation. The end portion of the first shaft 3 has a cylindrical cavity 16 whose inner surface is formed with a female thread. A detection rod 17 whose one end is formed on its outer surface with a male thread engageable with the female thread is screwed partway into the cylindrical cavity 16 and the remaining portion projecting out of the cylindrical cavity 16 is supported to be slidable in the axial direction but to be incapable of rotation. A sensor actuating element 18 is provided on the projecting portion of the detection rod 17 and sensors units 18' are fixed to, for example, the cover 34 so as to be positioned within the movement range of the sensor actuating element 18. When one of the sensors units 18' is electrically, optically or mechanically activated by the sensor actuating element 18, the direction of rotation of the second power source 30 is reversed.

The detection rod 17 is further provided with an indicator 19, and an immovable angle scale 19' is provided within the movement range of the indicator 19.

Thus when the drive gear 15 is driven to rotate by the second power source 30, the first shaft 3 and the second worm 14 are rotated, causing the detection rod 17 to move axially. When the projection of the detection rod 17 from the cylindrical cavity 16 reaches a prescribed point, one of the sensors units 18' detects the presence of the sensor actuating element 18 and produces a signal for reversing the rotation of the second power source 30. As a result, the drive gear 15 rotates the first shaft 3 and the second worm 14 in the opposite direction, thereby causing the detection rod 17 to move back into the cylindrical cavity 16. When the detection rod 17 has entered the cylindrical cavity 16 to a prescribed distance, the other of the sensors units 18' detects the presence of the sensor actuating element 18 and produces a signal for reversing the rotation of the second power source 30. As a result, the direction of rotation of the first shaft 3 and the second worm 14 is again reversed.

By appropriately selecting the distance between the sensors units 18' and their positional relation with the detection rod 17, therefore, it is possible to cause the first shaft 3 to reciprocate within the range of ±90°.

At an inner portion of the U-shaped interior of the partition frame 8, a cylindrical second shaft 20 which stands upright and communicates with the liquid passage 9 at its top and bottom ends is rotatably supported by bearings 21 provided in upper and lower plate portions of the partition frame 8.

A jet nozzle 22 of tapered cylinder shape which communicates with the interior of the second shaft 20 and extends forward therefrom is provided on the side of the second shaft 20. The second shaft 20 is formed at the middle of its outer periphery with a second worm gear 23 which engages with the second worm 14.

The second cylindrical member 6 is closed at its distal end and a washing liquid inlet pipe 24 is joined to the side thereof in a rotatable and liquid-tight manner. The inlet pipe 24 and the second cylindrical member 6 are in communication through openings 25 in the side wall of the second cylindrical member 6.

Washing liquid supplied from the inlet pipe 24 at high pressure enters the second cylindrical member 6 through the openings 25, passes through the bearing section 10 at the end of the second cylindrical member 6 and into the liquid passage 9 and the second shaft 20 and from the second shaft 20 to the jet nozzle 22, where it is jetted at high pressure from the nozzle port 22'.

When, as explained earlier, the rotation of the drive gear 15 by the second power source 30 is transmitted to the first shaft 3 and the second worm 14, this rotation is further transmitted at reduced speed to the second worm gear 23. As a result, the jet nozzle 22 is swung horizontally about the second shaft 20 in one direction until the accompanying movement of the detection rod 17 described above results in the detection of the sensor actuating element 18 by one of the sensors units 18', at which time the direction of rotation of the second power source 30 and, accordingly, that of the jet nozzle 22, is reversed. As a result, the jet nozzle 22 swings back and forth within a fixed range. This swinging of the jet nozzle 22 in opposite directions can be monitored from outside the tank by observing the position of the indicator 19 relative to the angle scale 19'.

Moreover, since the speed at which the jet nozzle 22 is swung by the first power source 29 and the second power source 30 can be varied by controlling the supply of driving fluid (oil or air) from a fluid source 49 through the use of a control valve or the like in the driving fluid supply pipe, the vertical and horizontal swing of the jet nozzle 22 can be controlled from the outside by controlling the first power source 29 and the second power source 30. The jet nozzle 22 can therefore be controlled to execute complex swing patterns. Motors and pumps driven by air or oil rather than electricity are used for the first power source 29 and the second power source 30 because the atmosphere at the installation site is highly explosive combustible gas which might be ignited by electric equipment or static electricity.

After the invention washer 1 described in the foregoing has been mounted on the cover 34 and the cover 34 has been attached at the opening section 33, high-pressure washing liquid is supplied to the inlet pipe 24, the first power source 29 is driven to rotate the casing 4 alternately in opposite directions about the first shaft 3 through the action of the first worm gear 12 and the first cylindrical member 5 and thus swing the jet nozzle 22 up and down by rotating the casing 4, and the second power source 30 is driven to rotate the first shaft 3 alternately in opposite directions through the drive gear 15 and thus swing the jet nozzle 22 back and forth horizontally through the action of the second worm 14 and the second worm gear 23. As a result the nozzle port 22' swings back and forth both vertically and horizontally within the prescribed ranges and at the prescribed speeds, thereby enabling the jetting of high pressure liquid in complex patterns.

Thus by connecting the supply pipe 42 with the inlet pipes 24 of the washers 1, as shown in FIGS. 1 and 3, and jetting high-pressure washing liquid from the nozzle port 22' of the jet nozzle 22, it is possible to clean the tank 31 by fluidizing and discharging sludge therefrom.

If desired, the maximum distance to which the detection rod 17 can project can be restricted by forming a shallow recessed portion 26 at the tip of the detection rod 17 and providing a stop rod 27 on the cover 34 with its distal end positioned to contact the recessed portion 26 when the detection rod 17 reaches a prescribed degree of projection.

While in the embodiment described in the foregoing the liquid jetting device is installed in a cover attachable to and detachable from an opening section formed in the bottom of a side wall of the tank, it is alternatively possible to install it in a cover attachable to and detachable from an opening section formed in the roof of the tank and to conduct the washing operation in exactly the same manner. The device can be attached directly to the side wall of the tank without utilizing the cover.

As described in the foregoing, the method for treating liquid in a tank according to the invention is characterized in that it comprises the steps of installing at least one liquid jetting device having a nozzle swingable in a vertical direction and a horizontal direction in a tank, providing the device with separate power sources for swinging the nozzle in the vertical and horizontal directions, jetting liquid from the nozzle at high pressure, monitoring the jetting of liquid from outside the tank, and simultaneously controlling the driving by the power sources from outside the tank to efficiently treat the liquid stored in the tank. The liquid jetted at high pressure from the nozzle of the liquid jetting device to fluidize and remove sludge deposits at the bottom of the tank can be liquid remaining inside the tank which is recirculated, with heating if necessary, or can be liquid obtained by recovering the liquid at the bottom of the tank to a reduced pressure recovery tank and reusing the recovered liquid for jetting at high pressure from the nozzle.

Thus, in accordance with the invention, the jet nozzle of the liquid jetting device is swung both vertically and horizontally by separate power sources for the different directions so as to enable the speed and angular range of the swings to be controlled from outside the tank. As a result, the jetting of the liquid from the port of the jet nozzle can be freely controlled, thereby enabling efficient, rapid and reliable treatment of the liquid stored in the tank. Since the device can be installed a cover at the tank side wall, the device can be attached to the tank with ease by merely replacing the cover and since no need arises for installation of the complex piping and wiring required heretofore, the installation and removal of the device and the provision of the piping is extremely simple. The setup in preparation for the treatment can therefore be completed in a short time. Since the jet nozzle is installed at the bottom of the tank where it is near the sludge, moreover, the liquid jetted from the nozzle port is able to manifest sufficient sludge breakdown power even when jetted at lower pressure than in the prior art. This eliminates the need for sophisticated and expensive equipment for jetting high pressure fluid and the dangerous work that the installation of such equipment involves.

The practical value of the liquid jetting device according to the invention is further enhanced by the fact that it can be utilized to wash either a tank which has residual oil or the like at the bottom or a tank that has been completely emptied of oil.

What is claimed is:

1. A method for treating liquid stored in a tank to remove precipitate deposited on a bottom of the tank, comprising the steps of:

installing a plurality of liquid jetting devices, each having a nozzle swingable in a vertical direction and a horizontal direction, in a lower side wall of a tank at predetermined intervals so that liquid can be jetted from the nozzle into the tank;

providing each liquid jetting device with separate power sources for swinging the nozzle thereof in the vertical and horizontal directions;

jetting liquid from the nozzle of each said liquid jetting device at high pressure;

monitoring, from outside the tank, the jetting of the liquid from the nozzle of each said liquid jetting device; and simultaneously controlling the swinging of the nozzles by the power sources from outside the tank to efficiently treat the liquid stored in the tank to remove the precipitate.

2. The method according to claim 1, further comprising the steps of forming a plurality of opening sections in the lower side wall of the tank, attaching a detachable cover to each opening section, and providing each liquid jetting advice in the detachable cover.

3. The method according to claim 1, further comprising the step of recirculating liquid remaining in the tank after the treatment and wherein the recirculated liquid is used as the liquid jetted from the nozzle at high pressure.

4. The method according to claim 3, wherein the recirculated liquid is heated and then used as the liquid jetted from the nozzle at high speed.

5. The method according to claim 3, further comprising the step of providing the liquid remaining in the tank after the treatment to a reduced pressure recovery vessel and wherein the recovered liquid is used as the liquid jetted from the nozzle at high pressure.

6. The method according to claim 1, further comprising the steps of stirring the liquid stored in the tank with the liquid jetted from the nozzle at high pressure, thereby fluidizing the precipitate, and removing the fluidized precipitate together with a mixture of the stored liquid and the jetted liquid.

7. The method according to claim 1, wherein the liquid jetted from the nozzle at high pressure is jetted directly onto the precipitate, thereby fluidizing the precipitate, and removing the precipitate together with the jetted liquid.

8. The method according to claim 1, further comprising the step of varying a supply of a driving fluid to the power sources so that the swinging of the nozzle by the power sources is controllable in angular range and speed from outside the tank.

9. A liquid jetting device comprising:

a plurality of frames mounted on a lower side wall of a tank to be cleaned at predetermined intervals;

a casing mounted to be swingable inside each frame;

a first shaft extending laterally inside the casing;

a jet nozzle having a port for jetting liquid and connected with the first shaft so as to be swingable in a direction perpendicular to the swinging direction of the casing;

a first power source supplied with driving fluid for swinging the casing;

a second power source supplied with driving fluid for swinging the jet nozzle in the direction perpendicular to the swinging direction of the casing; and means enabling the driving of the first and second power sources to be controlled from outside the tank in accordance with a state of liquid jetted from the port of the jet nozzle.

10. The liquid jetting device according to claim 9, wherein the driving fluid supplied to the first and second sources is air.

11. The liquid jetting device according to claim 9, wherein the lower side wall of the tank has a plurality of opening sections, further comprising a detachable cover that is attached to each opening section, and wherein each frame is mounted on the detachable cover.

* * * * *